US006107692A

United States Patent [19]

Egri et al.

[11] Patent Number: 6,107,692

[45] Date of Patent: Aug. 22, 2000

[54] AUXILIARY GENERATOR AND SYSTEM FOR ACTUATING THE SAME

[75] Inventors: Robert Gyorgy Egri, Wayland, Mass.; Kenneth Foster Folk, Harrisburg; Michael Fredrick Laub, Etters, both of Pa.

[73] Assignee: The Whitaker Corporation, Wilmington, Del.

[21] Appl. No.: 09/050,818

[22] Filed: Mar. 30, 1998

Related U.S. Application Data

[60] Provisional application No. 60/057,551, Aug. 29, 1997.

[51] Int. Cl.[7] ..... F03B 13/00

[52] U.S. Cl. ..... 290/43; 290/54

[58] Field of Search ..... 290/43, 44, 54, 290/55; 322/38; 60/407, 325

[56] References Cited

U.S. PATENT DOCUMENTS

| | | | |
|---|---|---|---|
| 2,806,149 | 9/1957 | Lillquist | 290/17 |
| 3,317,765 | 5/1967 | Cone | 310/74 |
| 3,703,146 | 11/1972 | Kovats | 105/61.5 |
| 3,911,301 | 10/1975 | Riley | 310/111 |
| 3,930,201 | 12/1975 | Ackermann et al. | 328/1 |
| 3,978,357 | 8/1976 | Voelbet et al. | 310/168 |
| 4,107,561 | 8/1978 | Schmidt | 310/95 |
| 4,243,892 | 1/1981 | Andersson et al. | 290/1 R |
| 4,409,490 | 10/1983 | Caputo | 290/4 D |
| 4,481,768 | 11/1984 | Goshorn et al. | 60/327 |
| 4,496,845 | 1/1985 | Ensign et al. | 290/43 |
| 4,511,806 | 4/1985 | May | 290/43 |
| 4,529,933 | 7/1985 | Bleeke | 324/173 |
| 4,553,723 | 11/1985 | Nichols et al. | 246/167 |
| 4,612,447 | 9/1986 | Rowe | 290/1 R |
| 4,658,168 | 4/1987 | Belart et al. | 310/168 |
| 4,700,133 | 10/1987 | Day | 324/208 |
| 4,797,611 | 1/1989 | Schreiber | 324/208 |
| 4,829,196 | 5/1989 | Bronicki et al. | 290/54 |
| 4,940,937 | 7/1990 | Hattori et al. | 324/207.2 |
| 4,964,345 | 10/1990 | Porel | 105/96.1 |
| 4,998,084 | 3/1991 | Alff | 335/306 |
| 5,079,468 | 1/1992 | Sata | 310/168 |
| 5,223,760 | 6/1993 | Peck et al. | 310/168 |
| 5,267,473 | 12/1993 | Bezos et al. | 73/129 |
| 5,488,287 | 1/1996 | Kemner et al. | 322/20 |
| 5,508,608 | 4/1996 | Goossens | 324/174 |
| 5,523,680 | 6/1996 | Sumi | 324/174 |
| 5,753,987 | 5/1998 | Shepherd et al. | 310/75 R |
| 5,775,229 | 7/1998 | Folk et al. | 105/157.1 |

FOREIGN PATENT DOCUMENTS

| | | | |
|---|---|---|---|
| 449538 A1 | 2/1991 | European Pat. Off. | H02K 21/14 |

OTHER PUBLICATIONS

Article, "Topologies for a Permanent Magnet Generator/Speed Sensor for the ABS on Railway Freight Vehicles"; Chaaban, Birch, Howe and Mellor; pp. 31–35. (source and date unknown).

*Primary Examiner*—Nicholas Ponomarenko

[57] ABSTRACT

A system for powering at least one of electronic devices or a battery includes a pneumatic supply source and an accumulator for storing a collected amount of the pneumatic supply. A pneumatically powered generator is connected to the accumulator for generating power upon receipt of the pneumatic supply. The generator is further connected to at least one electronic device and a battery. A microprocessor controls a storage amount of pneumatic supply within the accumulator, determines an output of the pneumatic supply to the generator, and applies an electrical output of the generator to at least one electronic device, a battery, or both an electronic device and a battery. The pneumatically powered generator is an electromagnetic generator having a rotor cavity separated by a wall of the generator housing from a stator and related magnetic disc. An inlet of the generator housing directs air at the rotor, thereby turning a common shaft of the rotor and the magnetic disc until a current is produced in windings of the stator. The current output from the stator windings is used to power peripheral devices including a chargeable battery and at least one electronic device if needed.

6 Claims, 3 Drawing Sheets

AUXILIARY GENERATOR AND SYSTEM FOR ACTUATING THE SAME

This application claims the benefit of U.S. Provisional Application(s) No(s). 60/057,551, filed Aug. 29, 1997.

FIELD OF THE INVENTION

The present invention relates to the field of generators. More particularly, the present invention relates to a turbine generator in which rotation of a turbine energizes an electromagnetic array thereby generating power. Still further, the present invention relates to a pneumatically actuated generator which will in turn power accessories or recharge a battery.

BACKGROUND OF THE INVENTION

In the environment of railroad cars, it is generally necessary to provide on-board electric power to electronic devices such as electronically controlled pneumatic (EPC) brakes, on-board monitoring devices, and other similar devices on a freight car, particularly if they are wireless systems. At this time, all of the proposed or installed systems have batteries charged from an on-board generator to supply power. A problem arises when the freight cars are not in use and they sit for several months. The batteries may lose their charge over time and need to be replaced or recharged before operating the freight car. In colder climates, this problem becomes worse since the batteries lose their charge delivering capacity faster at lower temperatures. For safety purposes, it is desirable to have the brakes of a rail car 100% operational before the train leaves the station. With a wireless ECP brake communication system, the on-board equipment cannot be charged by a head end unit (HEU) or by the generator in a stationary freight car.

Another problem with the currently planned and employed on-board charging system is that it relies on axle generators. The axle generator provides a voltage proportional to the train speed and it is very difficult and expensive to achieve sufficient voltage, usually at least 12V, at low speeds such as five to ten km/hour. Also, the voltage regulation at high speeds, where the voltage can reach well over 150V, can be costly and pose a technical challenge.

SUMMARY OF THE INVENTION

Accordingly, the present invention is directed to an inventive generator and system for implementing that generator as an alternative to the known systems. Briefly, the generator is coupled to and actuated by air from at least an air pipe of the freight car. The generator operates somewhat like a turbine when the air system on the freight car is being charged prior to use. Air passes through the generator thereby hitting the rotor blades and spinning a shaft. A polarized magnetic disc attached to the shaft creates an electromagnetic field producing an electrical current in stator windings of the generator. This current, once regulated, can be used to charge an on-board battery or provide power directly to electronic devices.

Normally, freight cars are left in railroad yards with their brake pipe pressurized to allow quick assembly of the train. The invention takes advantage of the pressurized brake pipe by using the air pressure to actuate the generator and recharge the freight car batteries and/or power accessories, if needed. A charge (or voltage) measuring device is used to continuously monitor the status of the battery when the freight car is stationary. If the voltage drops below a predetermined level indicating low deliverable battery charge, a valve is actuated to allow air through the generator and initiate recharging of the battery.

OBJECTS, FEATURES, AND ADVANTAGES

It is an object of the invention to provide a system for powering at least one electronic device and charging a battery.

It is another object of the invention to provide a pneumatically supplied system for powering at least one electronic device and a charging a battery.

It is still a further object of the invention to provide a system for powering at least one electronic device and charging a battery using a generator actuated by a pneumatic source.

It is yet another object of the invention to provide a system for powering at least one electronic device and charging a battery using an electromagnetic generator actuated by a pneumatic source.

It is still another object of the invention to provide a pneumatically actuated electromagnetic generator for supplying power to at least one electronic device and charging a battery.

These and other objects of the present invention are achieved by providing a system for powering at least one electronic device and charging a battery utilizing a pneumatic supply source. An accumulator is provided for storing a collected amount of the pneumatic supply, and a pneumatically powered generator is connected to the accumulator for generating power upon receipt of the pneumatic supply. The generator includes a regulator and is further connected at an output thereof to at least one electronic device and/or a battery. A control device such as a microprocessor controls a storage amount of a pneumatic supply within the accumulator, determines an output of the pneumatic supply to the generator, and applies an electrical output of the generator to selected ones of the at least one electronic device and battery.

The generator is an electromagnetic generator for powering electrical devices and includes a housing having an air inlet, an air outlet, a rotor cavity formed interiorly of the housing, and a recessed stator opening formed in a face of the housing. An axial shaft is positioned along a longitudinal axis of the housing, and a rotor is fixed on the shaft for rotation therewith and within the rotor cavity. Bushings rotatably support the shaft within the housing, and a magnetic disc is fixed to a distal end of the shaft for rotation therewith, the magnetic disc being centrally positioned within the stator recess. A stator member having a plurality of radially projecting stator windings is fixed to the face of the housing within the stator recess and arcuately surrounding a portion of the magnetic disc. A cover plate encases the stator member and the magnetic disc within the stator recess. An introduction of air to the inlet of the housing actuates the rotor, thereby rotating the magnetic disc within the stator member and producing an electrical current from the stator windings of the stator member.

BRIEF DESCRIPTION OF THE DRAWINGS

The present invention will become more fully understood from the detailed description given by way of illustration only, and thus are not limitative of the present invention, and wherein.

DETAILED DESCRIPTION OF THE INVENTION

While the present invention may have many applications, an exemplary application and related description follows. Specifically, a purpose of the present invention is to provide electric power to on-board electronic devices for railroad freight cars. To that end, the following is a detailed description of the invention.

Figure 1:
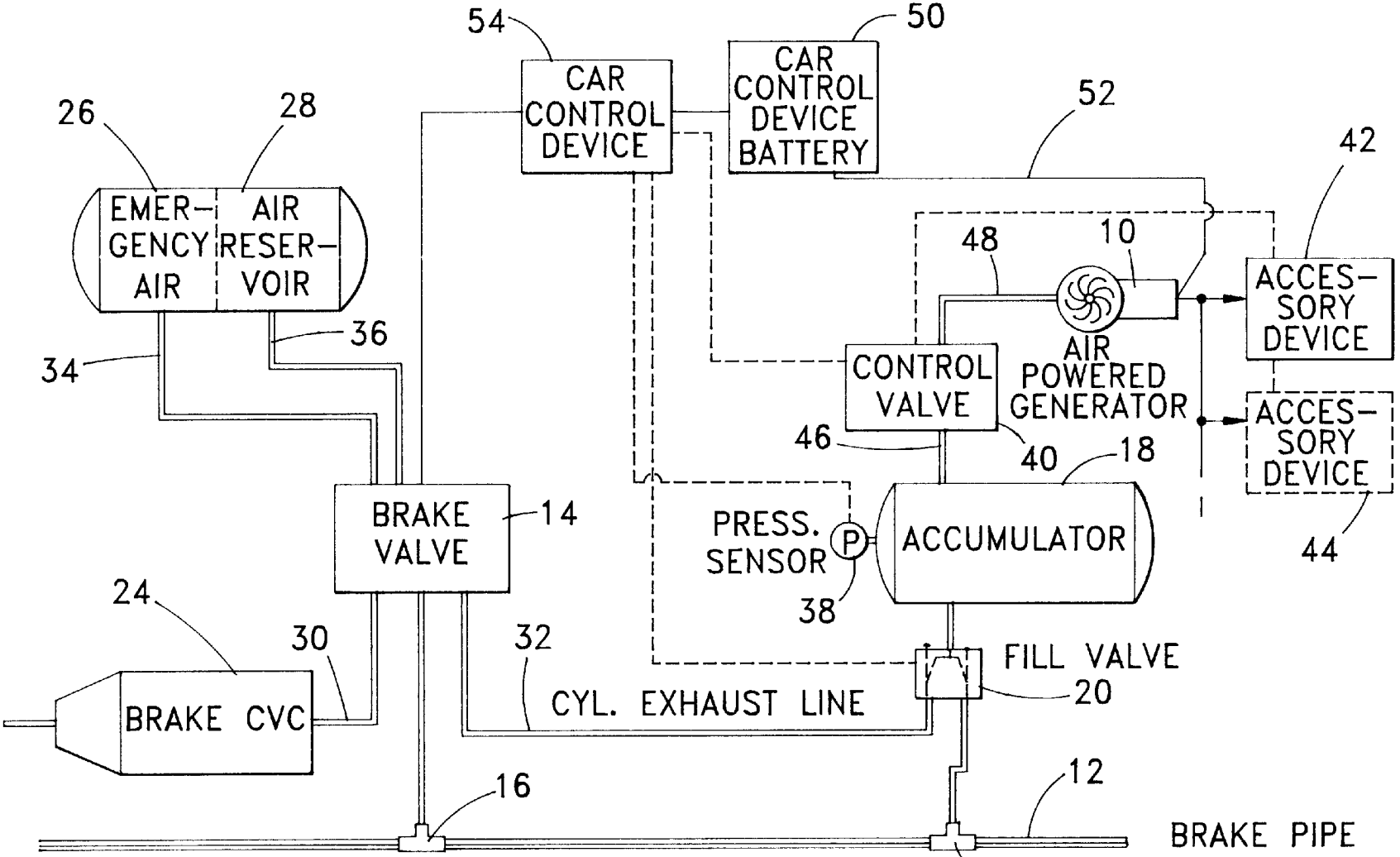
FIG. 1 is a schematic diagram of a system for actuating and providing an electrical output from an auxiliary generator according to a preferred embodiment of the present invention.

Referring first to FIG. 1, there is a schematic representation of an auxiliary generator included in a freight car, such that an air source is supplied to the air powered auxiliary generator.

More specifically, the system includes an air powered auxiliary generator 10 (hereinafter simply referred to as a generator) of a design which will be more fully set forth in the following, and additional components designed to either actuate or be powered by the generator 10 as needed. The entire system is designed to operate from air stored in a brake pipe 12 of a train car or an exhausted brake cylinder 24.

With respect to the brake pipe 12, it should be appreciated that a normal condition of the brake pipe 12 is to have the brake pipe pressurized. This normally pressurized brake pipe 12 is coupled to a brake valve 14 through a coupling 16. In addition, the brake pipe 12 has a coupling 22 directed toward an accumulator 18. As shown in FIG. 1, a fill valve 20 is interposed between the coupling 22 and the accumulator 18 for regulating the supply of air from the brake pipe 12 to the accumulator 18.

The fill valve 20 additionally controls the supply of reclaimed air from the brake cylinder 24 to the accumulator 18. Thus, the fill valve 20 is accessible by either the reclaimed air from the brake cylinder 24 or the brake pipe 12 to be used at specific times as needed. The fill valve 20 may be of any suitable type to dispense the pressurized air from either the brake valve 14 or the brake pipe 12 to the accumulator 18. The brake valve 14 is connected, as indicated, to the brake cylinder 24 at feed line 30 and to the fill valve 20 of the accumulator 18 via a cylinder exhaust line 32. The brake valve 14 further acts as a supply source for both an emergency air cylinder 26 and an air reservoir 28 via supply lines 32 and 34, respectively.

The accumulator 18 is simply a container of a predetermined size which stores air from light periods of duty cycle in the brake pipe 12 and from exhausted brake cylinder air. The accumulator 18 is monitored by a pressure sensor 38 connected to the accumulator 18 such that the pressure sensor 38 determines the need for the fill valve 20 to supply air to the accumulator 18.

A control valve 40 is positioned on an output side of the accumulator 18 and selectively applies pressurized air to drive the generator 10. A supply line 46 connects the accumulator 18 to the control valve 40 and a further supply line 48 connects the control valve 40 to the generator 10. An electrical output from the generator 10 powers one or more of the accessories 42 and 44. Output from the generator 10 additionally supplies charging power to an on-board battery 50 through connector 52. The generator 10 is inclusive of a regulator for regulating the output of the generator. It should be understood, however, that the regulator need not be included with the generator per se and may be positioned separate from the generator, and may include separate regulators for the at least one accessory 42, 44, and the battery 50.

A car control device (CCD) 54 is connected to each of the battery 50, the control valve 40, the pressure sensor 38, the fill valve 20, and the brake valve 14 by known types of leads, and operates as a microprocessor to electronically monitor and regulate all components as needed.

Accordingly, air supplied to the accumulator 18 is used for a number of purposes, including being stored as a pneumatic pressure source during light periods of duty cycle, and storing exhausted brake cylinder air. Additionally, the accumulator 18 allows accessory operation and charging of the on-board battery 50 when air is not available during normal running of the car.

It will be appreciated that the arranged elements may be specific according to needs of the car. For example, the generator 10 may run the accessories 42, 44, but not the battery 50; the generator 10 may run only when an accessory 42, 44 is sampling; or the generator 10 may run the accessories 42, 44, the battery 50, or both the accessories and the battery.

Figure 2:
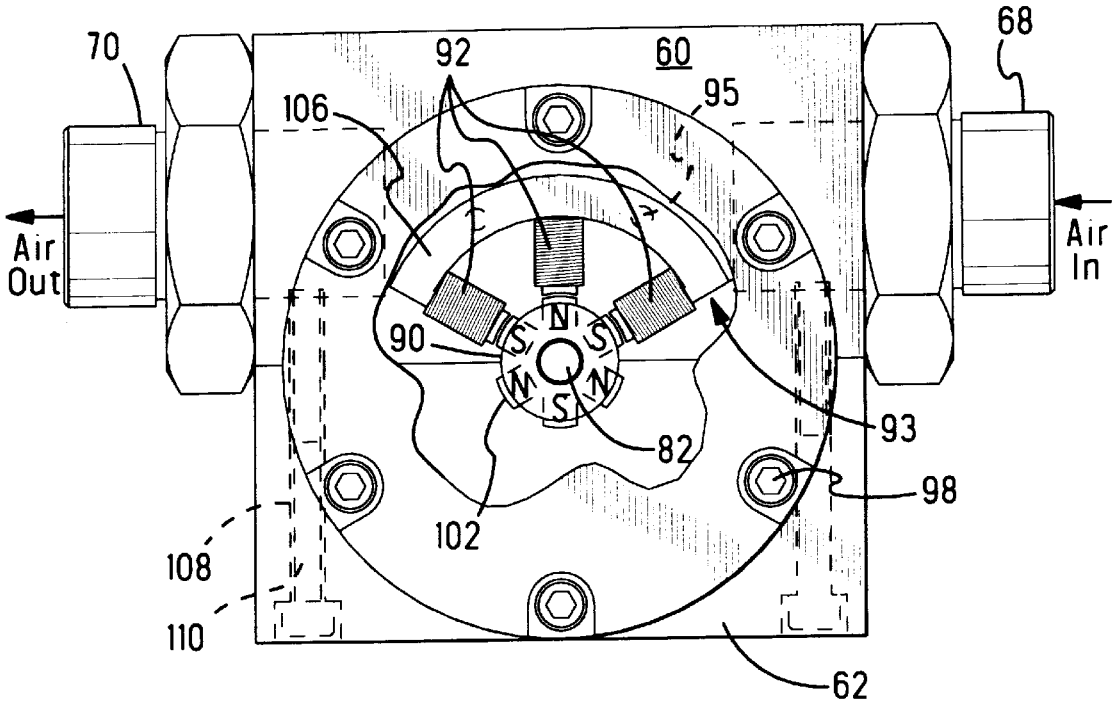
FIG. 2 is a front cross-sectional view of the auxiliary generator shown in FIG. 1.
Figure 3:
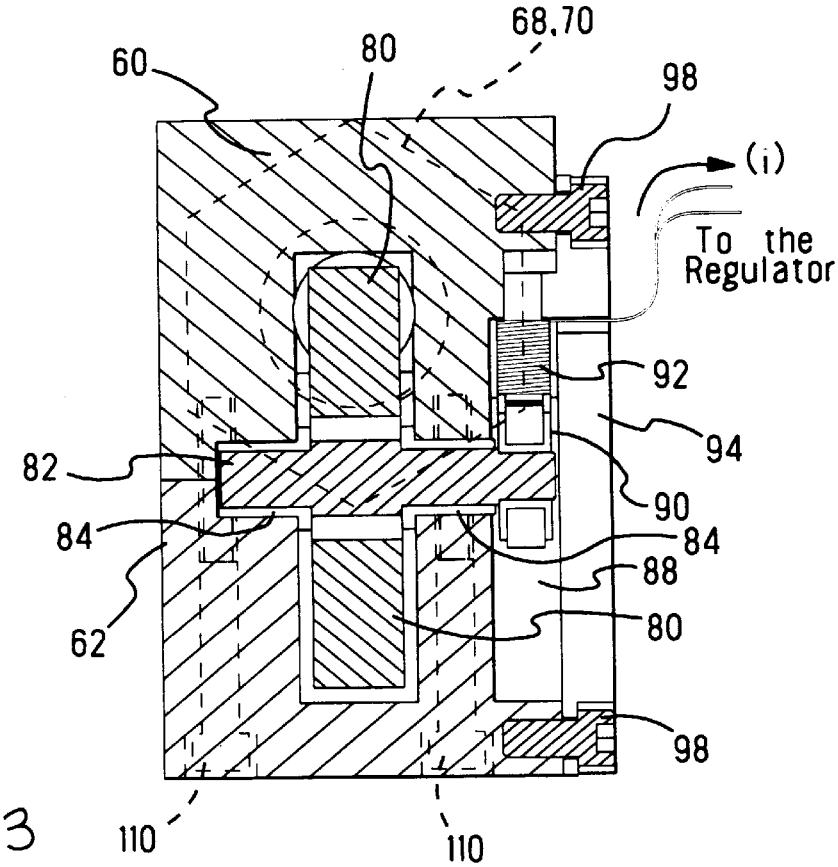
FIG. 3 is a side cross-sectional view of the auxiliary generator shown in FIG. 2.
Figure 4:
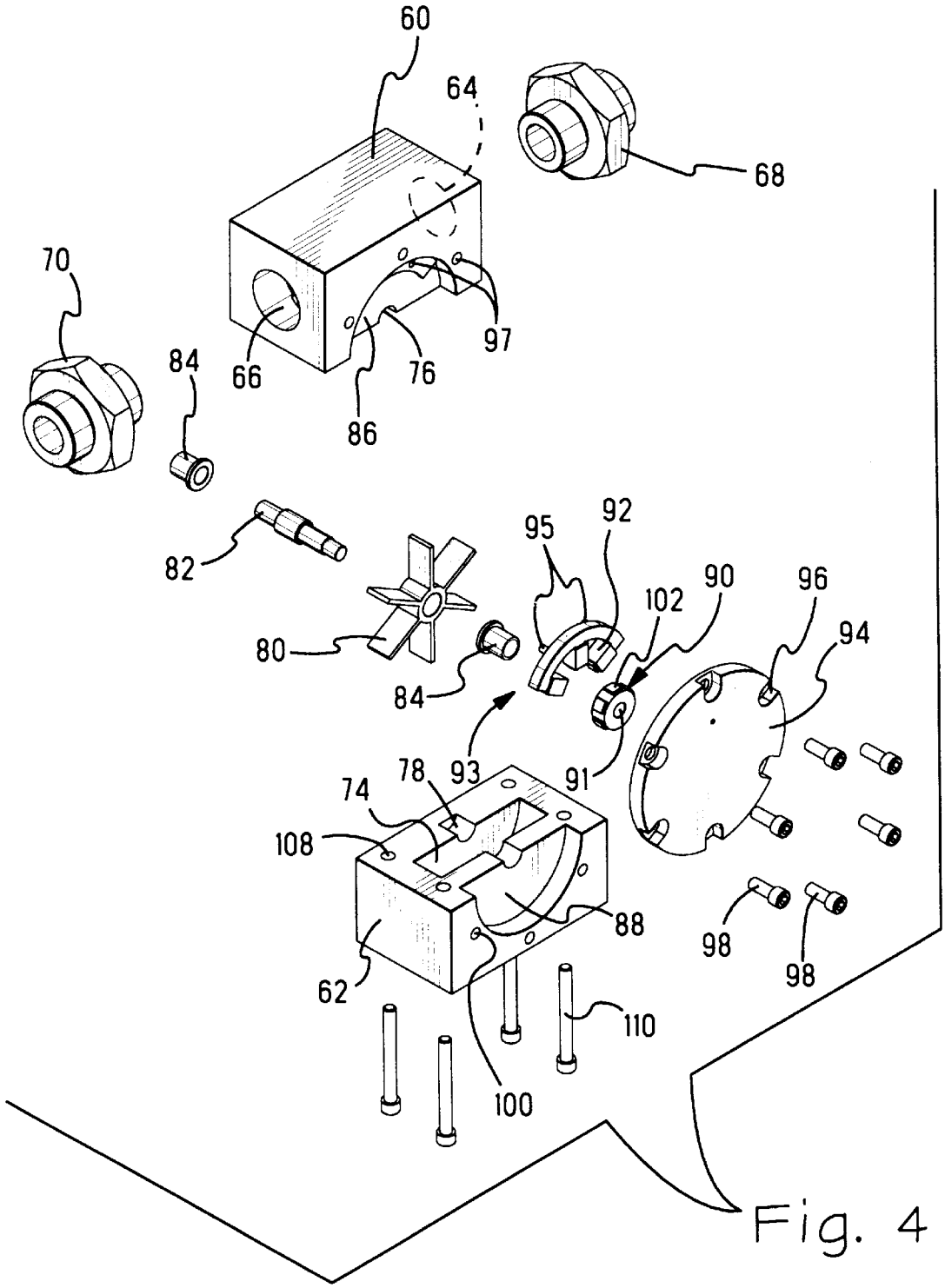
FIG. 4 is an exploded perspective view of the auxiliary generator shown in FIG. 1.

In addition to the system described above, the generator 10 is shown in further detail in FIGS. 2 through 4 and is a necessary component of the overall system.

Specifically, the generator 10 includes an upper housing 60 and a lower housing 62, which combine to form the entire housing for the generator 10. The upper housing 60 includes an air intake opening 64 and an air outlet opening 66. An intake air fitting 68 of a suitable type is either friction fit, welded, or threadably coupled to the air intake opening 64 and an air outlet fitting 70 of a suitable type is either friction fit, welded, or threadably coupled to the air outlet opening 66.

The upper 60 and lower 62 housing portions are machined to have a hollowed opening therein at 72 and 74, respectively, with an axial recess 76, 78, respectively, formed at an inner longitudinal axis of the combined upper and lower housings. The hollowed opening 72, 74 is of a shape to accommodate a rotor 80 therein. The rotor 80 is journaled to receive a shaft 82 through a central axis thereof. The rotor 80 is secured on the shaft 82 by a pair of bushings 84 at opposing ends of the shaft and the bushings are seated in the axial recesses 76, 78.

A coplanar external face of the upper and lower housings 60, 62 is recessed at 86 and 88, respectively, to form a disc shaped opening in the face of the combined housings. A magnetic disc 90 having an aperture 92 therein is fit on a distal end of the shaft 82 so as to rotate with the shaft. A stator 93 having a plurality of integrally formed stator windings 92 is mounted to an exposed face of the recessed area 86 in the upper housing portion 60. In particular, at least a pair of pins 95 protrude from a rear surface of the stator 93, the pins 95 being inserted into corresponding holes 97 formed in the face of the recess 86. Thus, the stator 93 is fixed against the upper housing 60 and immovable relative to the rotation of the magnetic disc 90.

In order to secure the magnetic disc 90 and stator 93 against the housing 60, 62 and within the recessed area 86, 88, a cover plate 94 is mounted to the housing portions 60, 62. More particularly, an outer periphery of the cover plate 94 has a plurality of apertures 96 formed therein for receiving a corresponding plurality of bolts 98. Each aperture 96 in the cover plate 94 is aligned with a corresponding aperture 100 in the upper 60 and lower 62 housings. Thus, the bolts 98, when inserted into the plurality of apertures 96 in the cover plate 94 will extend into the apertures 100 of the housings 60, 62. Accordingly, the plurality of bolts 98 secure the cover plate 94 to the housings 60, 62 and in turn create an enclosed recess 86, 88 within which the magnet 90 rotates relative to the stator 93.

The magnetic disc 92 includes a predetermined number, for example six, alternatingly oriented magnets 102. In other words, opposite poles of each magnet 102 are alternated to extend in a radially outward direction with respect to the longitudinal axis of the shaft 82. The stator windings 92 are each formed to surround a single arm 104 projecting radially inward from an arcuate support member 106 of the stator 93. Three stator windings 92 are shown, with each stator winding being spaced a distance apart to correspond to a spacing of the plurality of magnets 102.

In order to secure the upper housing 60 to the lower housing 62, a plurality of apertures 108 are formed to extend through the lower housing and into a portion of the upper housing 60. A corresponding plurality of threaded bolts 110 are inserted into the apertures 108 to secure the housings 60, 62 together as a unitary structure.

In operation, when a low battery charge is indicated or detected by the car control device 54, the control valve 40 is opened to let air through the air inlet fitting 68. Air passing through the inlet fitting 68 hits the rotor blades of the rotor 80 which in turn spins the shaft 82 which is mounted on the bushings 84. Since the magnetic disc 90 is fixed to the end of the shaft 82, as the shaft turns, the magnetic disc 90 rotates within the stator windings 92 and produces an electromagnetic field resulting in a current (i) being induced in the stator windings 92. The output from the stator windings 92 is attached to a regulator circuit of the generator 10 which is used to power the electronic accessory devices 42, 44 directly. Alternatively or simultaneously, the output can be input to a charging circuit for the on-board battery 50. Exhausted air from the generator is expelled through the outlet 66 and corresponding fitting 70.

Accordingly, electric power can be provided to on-board electronic devices and a chargeable battery for freight cars by utilizing stored pneumatic pressure exhausted from a brake cylinder or brake pipe on a stationary freight car.

The invention having been described, it is clear that certain modifications and variations of the pneumatic control system for and the generator can be made without departing from the spirit and scope of the invention. These modifications may include application of the system and generator to alternative devices where a pneumatic source is available, using liquid as the pneumatic source instead of air, and modification of existing components to suit a particular application.

To this end, use of other materials as well as their subassemblies is considered within the purview of the ordinary skilled artisan. These obvious modifications and variations are within the theme and spirit of the invention and are considered within the scope of the following claims.

What is claimed is:

1. A system for generating electrical power comprising:

an external pneumatic fluid supply source;

a pneumatic fluid accumulator connected to said external pneumatic fluid supply source for accumulating and storing said fluid;

a generator, having a pneumatic drive element, connected to said pneumatic fluid accumulator, for generating electrical power upon receipt of the fluid from said pneumatic fluid accumulator by said pneumatic drive element;

control means;

a fill valve interposed between said external pneumatic fluid supply source and said pneumatic fluid accumulator for regulating the flow of said fluid to said pneumatic fluid accumulator in response to a first signal from said control means;

a pressure sensor connected to said pneumatic fluid accumulator for outputting information indicating the accumulator fluid pressure in said pneumatic fluid accumulator to said control means; and a control valve interposed between said accumulator and said generator for controlling said fluid flow to said generator in response to a second signal from said control means, wherein said control means perform at least the following:

controlling the collected amount of said fluid within said pneumatic fluid accumulator by said first signal to said fill valve, determining the amount of said fluid in said pneumatic fluid accumulator from the information output from said pressure sensor, controlling the amount of said fluid discharged to said pneumatic drive element of said pneumatic fluid generator by said second signal, and controlling the output of the electrical power from said generator to a load.

2. The system according to claim 1, wherein the fluid supplied by said pneumatic fluid supply source is air.

3. The system according to claim 1, wherein said generator is an electromagnetic generator.

4. The system according to claim 1, wherein said control means is a microprocessor device.

5. The system according to claim 1, wherein said control means is a microprocessor device connected to each of said fill valve, pressure sensor, control valve, generator and at least one electronic device.

6. The system according to claim 5, wherein said generator is an electromagnetic generator.

* * * * *